US010836526B2

(12) United States Patent
Doppler et al.

(10) Patent No.: US 10,836,526 B2
(45) Date of Patent: Nov. 17, 2020

(54) METHOD FOR PICKING GOODS IN BAGS

(71) Applicant: TGW Logistics Group GmbH, Marchtrenk (AT)

(72) Inventors: Christoph Doppler, Wolfsegg am Hausruck (AT); Harald Schroepf, Wels (AT)

(73) Assignee: TGW Logistics Group GmbH, Marchtrenk (AT)

( * ) Notice: Subject to any disclaimer, the term of this patent is extended or adjusted under 35 U.S.C. 154(b) by 401 days.

(21) Appl. No.: 15/735,228

(22) PCT Filed: Jun. 9, 2016

(86) PCT No.: PCT/AT2016/050190

§ 371 (c)(1),
(2) Date: Mar. 23, 2018

(87) PCT Pub. No.: WO2016/197176

PCT Pub. Date: Dec. 15, 2016

(65) Prior Publication Data

US 2018/0194500 A1 Jul. 12, 2018

(30) Foreign Application Priority Data

Jun. 12, 2015 (AT) ..... 50484/2015

(51) Int. Cl.
*B65B 43/54* (2006.01)
*B65B 43/34* (2006.01)
(Continued)

(52) U.S. Cl.
CPC ..... *B65B 43/54* (2013.01); *B65B 5/067* (2013.01); *B65B 43/32* (2013.01); *B65B 43/34* (2013.01); *B65B 67/1238* (2013.01)

(58) Field of Classification Search
CPC ..... B65B 43/32; B65B 43/34; B65B 43/54; B65B 5/067; B65B 67/1238; G01S 5/186; G01S 11/16
See application file for complete search history.

(56) References Cited

U.S. PATENT DOCUMENTS 4,628,007 A 12/1986 Ledsham
4,749,011 A 6/1988 Rylander
(Continued)

FOREIGN PATENT DOCUMENTS

CA 2 725 915 A1 6/2012
CN 103748013 A 4/2014
(Continued)

OTHER PUBLICATIONS

International Search Report of PCT/AT2016/050190, dated Oct. 10, 2016.
(Continued)

*Primary Examiner* — Andrew M Tecco
*Assistant Examiner* — Nicholas E Igbokwe
(74) *Attorney, Agent, or Firm* — Collard & Roe, P.C.

(57) ABSTRACT

A method for picking goods (4*a* . . . 4*c*) in a picking zone is proposed, whereby at least one bag (6) and a box-shaped loading aid (5*a* . . . 5*d*) are provided, the bag (6) is inserted in the box-shaped loading aid (5*a* . . . 5*d*), a picking aid (7*a* . . . 7*d*) is inserted in the bag (6), goods (4*a* . . . 4*c*) are packed in the bag (6) and the box-shaped loading aid (5*a* . . . 5*d*) together with the bag (6) and the goods (4*a* . . . 4*c*) is finally transported out of the picking zone.

12 Claims, 3 Drawing Sheets

Figure 1:
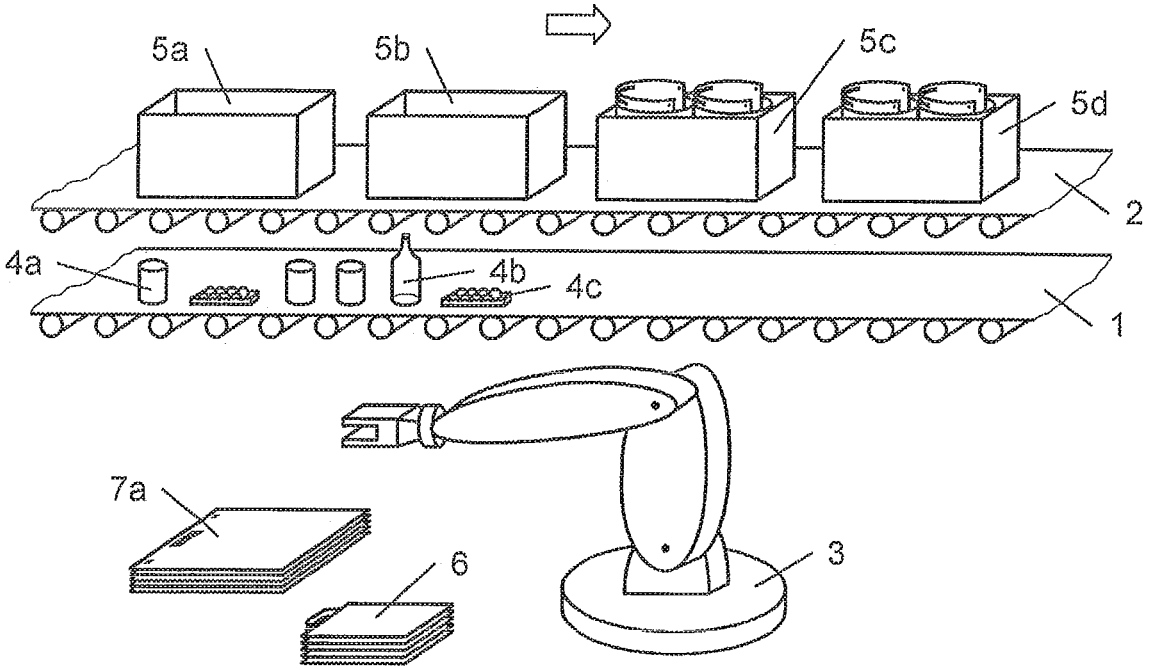

(51) Int. Cl.

| | |
|---|---|
| ***B65B 5/06*** | (2006.01) |
| ***B65B 67/12*** | (2006.01) |
| ***B65B 43/32*** | (2006.01) |

(56) References Cited

U.S. PATENT DOCUMENTS

| | | | | |
|---|---|---|---|---|
| 5,226,554 | A | 7/1993 | Dauphinais | |
| 5,716,033 | A | 2/1998 | Gibson | |
| 6,044,877 | A | 4/2000 | Bennet | |
| 6,065,512 | A | 5/2000 | Munn, II | |
| 6,296,212 | B1 | 10/2001 | Monahan | |
| 6,340,037 | B1 * | 1/2002 | Stafford | B65B 67/1205 141/316 |
| 2003/0196413 | A1 * | 10/2003 | Schapiro | B65B 51/02 53/449 |
| 2005/0112327 | A1 * | 5/2005 | Skaggs | B65D 33/007 428/156 |
| 2005/0178931 | A1 | 8/2005 | Tomlin | |
| 2009/0288996 | A1 * | 11/2009 | Shafer | B65G 1/1378 209/546 |
| 2010/0106297 | A1 * | 4/2010 | Inazumi | G01S 5/186 700/245 |
| 2010/0243650 | A1 | 9/2010 | Manley | |
| 2011/0153065 | A1 * | 6/2011 | Tomioka | B25J 9/1687 700/226 |
| 2012/0219241 | A1 | 8/2012 | Horton | |
| 2012/0279610 | A1 | 11/2012 | Krum | |
| 2013/0105036 | A1 * | 5/2013 | Smith | B65B 5/061 141/1 |
| 2013/0110280 | A1 * | 5/2013 | Folk | B25J 15/0057 700/215 |
| 2014/0286595 | A1 * | 9/2014 | Moreschini | A61L 2/26 383/33 |
| 2014/0352844 | A1 * | 12/2014 | Page | B65B 43/52 141/114 |
| 2015/0127161 | A1 * | 5/2015 | Satou | B25J 9/1697 700/259 |
| 2016/0096643 | A1 * | 4/2016 | Baylor | B25J 15/0616 53/443 |

FOREIGN PATENT DOCUMENTS

| | | | |
|---|---|---|---|
| DE | 10 35 557 | B | 7/1958 |
| DE | 9416136 | U1 | 1/1995 |
| DE | 20 2012 008 165 | U1 | 3/2013 |
| GB | 2 431 392 | A | 4/2007 |
| GB | 2 488 343 | A | 8/2012 |
| JP | S60-56326 | U | 4/1985 |
| JP | 2007-84089 | A | 4/2007 |
| WO | 2013/024154 | A1 | 2/2013 |

OTHER PUBLICATIONS

Letter of Austrian Patent Attorney to European Patent Office in PCT/AT2016/050190, dated Apr. 10, 2017.

* cited by examiner

METHOD FOR PICKING GOODS IN BAGS

CROSS REFERENCE TO RELATED APPLICATIONS

This application is the National Stage of PCT/AT2016/050190 filed on Jun. 9, 2016, which claims priority under 35 U.S.C. § 119 of Austrian Application No. A 50484/2015 filed on Jun. 12, 2015, the disclosure of which is incorporated by reference. The international application under PCT article 21(2) was not published in English.

The invention relates to a method for picking goods in a picking zone wherein goods, at least one bag and a box-shaped loading aid are provided, the at least one bag is inserted in the box-shaped loading aid, the goods (based on a picking order) are placed in the at least one bag and the box-shaped loading aid together with the bag and the goods are transported away.

Such a method is known in principle from the prior art. As a rule, special box-shaped loading aids are used for this purpose and have a device for hanging the bags so that an opening of the bags is held open to enable them to be filled.

Problematic aspects of this are the sometimes difficult operation of hanging the bags in the holding device of the box which prolongs the loading process, the fact that special boxes are needed for the known picking methods and the fact that the bags are not strong enough to hold the packed goods in their designated place, especially at the acceleration rates which occur on a conveyor system or in a transport vehicle. If the containers packed in the bag have sufficient intrinsic stability, this is not a problem. Due to the efforts made to use as few materials as possible for the containers, however, this condition is not usually satisfied in practice. For example, heavy food cans packed in one bag can damage tomatoes packed in an adjacent bag if subjected to high accelerations. The thin material of a plastic bag or paper bag can often not prevent this.

Another approach to the process of packing bags as such known from the prior art is to use a packing aid, for example as described in U.S. Pat. No. 4,749,011 A. In this instance, the packing aid is inserted in a bag, the bag is filled with leaves or garden waste for example, and the packing aid is then pulled out of the bag again after the filling operation. The packing aid facilitates the process of filling the bag with bulky material. The bag is able to stand up with sufficient stability after filling due to the bulky material, even without a packing aid.

It is therefore an objective of the invention to specify an improved method for picking goods in bags. In particular, the picking operation as such should be made easier and thus speeded up and the risk of damage to sensitive goods during transportation reduced.

The objective of the invention is achieved by a method of the type outlined above whereby, prior to packing the goods in the at least one bag, a picking aid is inserted in the bag, by means of which a filling opening of the at least one bag is held open at least for the duration of the picking operation.

Inserting the picking aid in the bag is tantamount to packing the goods in the bag in terms of motion sequence, as a result of which the movements effected during the picking operation are fluid and can therefore be performed rapidly and reliably. Secondly, the stability of the bag is also significantly increased due to the picking aid, not only during packing but also during the transportation thereof. As a result of the proposed feature, therefore, the picking operation is made easier and faster on the one hand but the risk of damage to more sensitive goods during transportation is reduced. Another advantage of the proposed method is that in parallel with the inward transport of a loading aid, bags can be made ready with packing aids.

There is no restriction on a bag in terms of its size but the invention relates in particular to bags which are used in commerce for manually transporting goods and therefore have a volume of approximately 10 to 30 liters. These bags are often made from plastic or paper. Bags are usually limp but are designed so that they are able to stand up of their own volition, for example. In the context of the invention, the term "bag" is used synonymously in particular for the terms "pouch", "carrier bag", "pack" and "tote".

By "box-shaped loading aid" is meant in particular a container, a crate or box with a closed base and closed walls, although in principle the base and walls may also have cut-outs and be based on a basket-type design. In particular, the box-shaped loading aid is of a substantially cuboid shape. However, it may also be of any other basic shape.

The proposed method relates in particular to a conveyor system preferably operated on an automated basis which is intended for conveying rigid and/or intrinsically stable objects but not for conveying (solely) limp objects. In particular, intrinsically stable objects should be understood as meaning the aforementioned loading aids whereas limp objects should be understood as meaning the aforementioned bags. In particular, the proposed method therefore relates to a conveyor system preferably operated on an automated basis which is suitable for conveying box-shaped loading aids but not for conveying limp bags without box-shaped loading aids.

Advantageous embodiments and features of the invention will become apparent from the dependent claims and from the description given with reference to the drawings.

It is of advantage if a (cylindrical) tubular or funnel-shaped picking aid is placed in the at least one bag. This makes the bag very stable whilst it is being filled and as it is conveyed. Also of advantage is the fact that the tubular or funnel-shaped picking aid has a basic shape that can be inserted in the bag without having to be deformed. Compared with a tubular picking aid, a funnel-shaped picking aid has the advantage of being easier to insert as well as the advantage that it enables several funnel-shaped picking aids to be stacked in a space-saving arrangement.

It is also of particular advantage if a board-shaped, flexible picking aid is rolled up and inserted in the at least one bag. Based on this embodiment, therefore, a more or less flat board is rolled up, in particular to form a closed or open (cylindrical) tube or to form a closed or open (conical) funnel. The terms "open" and "closed" in this context refer to the jacket of the cylinder or cone. If $d \cdot \pi \leq l$ stands for the diameter d of the cylinder or the biggest diameter d of the cone, where l is the length of the rolled-up board, the tube or funnel is closed. If $d \cdot \pi > l$, the tube or funnel is open. The advantage of this embodiment is that the picking aid can be easily adapted to different sizes of bags.

In the above connection, it is also of advantage if the board-shaped, flexible picking aid is released in the at least one bag. In this manner, the opening of the bag is effectively spread open and the bag also stands up in a relatively stable arrangement. This variant is also particularly suitable for use with paper bags which barely stretch and cannot therefore be readily adapted to tubular or funnel-shaped picking aids.

It is also of advantage if the picking aid remains in the at least one bag when the box-shaped loading aid is being conveyed. In other words, a combination of the box-shaped loading aid, the bag, picking aid and goods can be conveyed out of the picking workstation with the aid of a conveyor system (e.g. conveyor belt, conveyor rollers, conveyor chain). As a result, the bags retain their shape, even when subjected to high accelerations. Goods in one bag cannot therefore damage goods in another bag. For example, heavy food cans packed in one bag will not then damage tomatoes in an adjacent bag even if they are exposed to high accelerations. The picking aid can therefore stay where it is as the loading aid is being transported on a conveyor system (e.g. in a warehouse or distribution center) but then be removed as the bags are transferred to a vehicle in the area of the dispatch point. However, it would also be conceivable for the picking aids to be left in the bags during transportation in a vehicle as well. The goods can be transported loose in the vehicle or left in the loading aid. For example, return of the picking aids and/loading aids or can be assured with the aid of a deposit scheme.

It is also of advantage if the at least one bag and the box-shaped loading aid are held in readiness in a preparation zone, in which case the at least one bag is placed in the box-shaped loading aid and then the box-shaped loading aid with the at least one bag is conveyed out of the preparation zone into the picking zone and the goods are packed in the at least one bag in the picking zone. The box-shaped loading aid together with the at least one bag is conveyed out of the preparation zone into the picking zone on a (second) conveyor system. Accordingly, the preparation zone and picking zone are disposed one after the other in the conveying direction of the box-shaped loading aid and along the (second) conveyor system. Running the preparation and picking operations in parallel enables a high picking efficiency to be achieved. The at least one bag and the box-shaped loading aid respectively can be made available in the preparation zone in the form of stacks, for example. Alternatively, the box-shaped loading aid can also be brought into the preparation zone on a (second) conveyor system already and only the bags are made available as stacks in the preparation zone.

It has proved to be of advantage if the picking aids are also held in readiness in the preparation zone, in which case the picking aid is placed in the at least one bag before the box-shaped loading aid is conveyed out of the preparation zone into the picking zone. In this connection, the picking aid can be placed in the at least one bag even before the at least one bag is placed in the box-shaped loading aid or the at least one bag is placed in the box-shaped loading aid first of all, after which the picking aid is placed in the at least one bag. This preparation process takes place away from the picking zone, namely in the preparation zone, so that the highest picking rates can be achieved. The picking operation is essentially limited to packing the previously prepared bags with goods. After packing the goods in the bags, the picking aids may optionally be removed from the bags.

Alternatively, the picking aid can be held in readiness in the picking zone, in which case the picking aid is placed in the at least one bag in the picking zone. Such a variant is particularly suitable for medium to high picking rates and offers an advantage in that such a picking system can be set up in a particularly space-saving layout.

Based on another embodiment of the invention, the at least one bag, the box-shaped loading aid and the picking aid are held in readiness in a picking zone and the at least one bag is placed in the box-shaped loading aid first of all, after which the picking aid is placed in the at least one bag or vice versa and finally the goods are packed in the at least one bag.

In this case, the picking operation not only comprises filling the bag with goods but also placing the at least one bag in the box-shaped loading aid and placing the picking aid in the at least one bag. The at least one bag, the picking aid and the box-shaped loading aid respectively can be held in readiness in the picking zone in the form of stacks, for example. Alternatively, the box-shaped loading aid may also be brought into the picking zone on a (second) conveyor system already and only the bags and picking aids respectively are held in readiness in the preparation zone as stacks. Such a picking system may be of a particularly space saving design and a robot or a manual picker will be sufficient to process the picking operation.

However, it is also of advantage if the picking aid is removed from the bag before the box-shaped loading aid is conveyed out of the picking zone in which the goods were packed in the at least one bag. As a result, a combination of the box-shaped loading aid, the bag and the goods are conveyed away from the picking workstation with the aid of a conveyor system (e.g. conveyor belt, conveyor rollers, conveyor chain). In this instance, only a small number of picking aids are needed for the proposed method.

It is also of advantage if the picking aid is removed from the at least one bag after conveying the box-shaped loading aid out of the picking zone in which the goods were packed in the at least one bag. The picking aid is removed after the picking operation away from the picking zone. This again enables very high picking rates to be obtained and takes place independently of the picking operation.

It is also of advantage if the picking aid is stored flat after having been removed from the at least one bag. By forming stacks of several flat picking aids, the latter can be stored in a particularly space saving arrangement.

Finally, it is of particular advantage if a total surface area of opening cross-sections of the bags to be placed in the box-shaped loading aid, which results when the openings of all the bags (6) are shaped to circles or squares, exceeds the base surface of the loading aid (5*a* . . . 5*d*). This being the case, the best possible use can be made of the loading aid on the one hand and the bags will stand in the loading aid in a very stable manner and retain their shape and position in the loading aid even under the effect of high accelerations on the other hand. In this context, the notional formation of the openings of all the bags respectively constituting a circle or square refers to the freely unfolded state of the bags, in other words when they have not as yet been placed in the loading aid. Generally speaking, a circular or square opening may also be formed by bags having a different base surface. For example, a paper bag may have an intrinsically rectangular base surface but its opening may have the shape of a circle or square.

Calculating back to the circumference, the above condition for the square opening can also be expressed as follows:

$$\sum A_{bag} = \sum a^2 = \sum \left(\frac{U}{4}\right)^2 = \frac{1}{16} \cdot \sum U^2 > A_{loading\ aid}$$

and for the circular opening by:

$$\sum A_{bag} = \sum r^2 \cdot \pi = \sum \left(\frac{U}{2\pi}\right)^2 \cdot \pi = \frac{1}{4\pi} \cdot \sum U^2 > A_{loading\ aid}$$

where $A_{bag}$ denotes the opening cross-section of a bag, $A_{loading\ aid}$ the base surface of the loading aid, U the circumference of the opening of the bag, a the side edges of the opening shaped to form a square and r the radius of the opening shaped to form a circle.

In other words, the sum of the squared circumferences of the bags to be placed in the box-shaped loading aid represents more than 16-times or 4π-times the base surface of the loading aid.

The use of circular openings is predominantly suitable when loading round loading aids and the use of square openings predominantly suitable when packing loading aids with a rectangular or square base surface. Naturally, when loading a loading aid with a rectangular or square base surface it is also possible to apply the circular opening of the bags in calculating the above condition and vice versa.

At this stage, it should be pointed out that the real opening of the bag which occurs when it is being used is very rarely circular or square and as a rule has a more general shape. When using a board-shaped, flexible picking aid rolled up to form an open tube, arcuate curves connected by a straight line are formed on the edge of the bag in particular, for example a "clipped" Circle or a "clipped" parabola, ellipsis or similar.

To provide a clearer understanding, the invention will be described in more detail with reference to the appended drawings.

Figure 2:
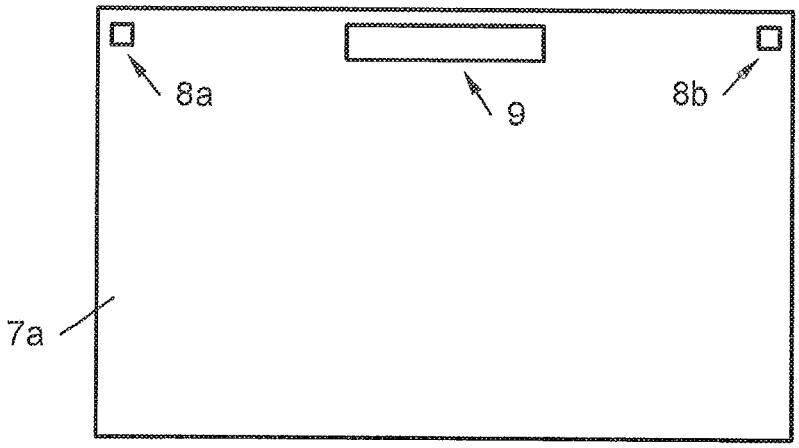
Figure 3:
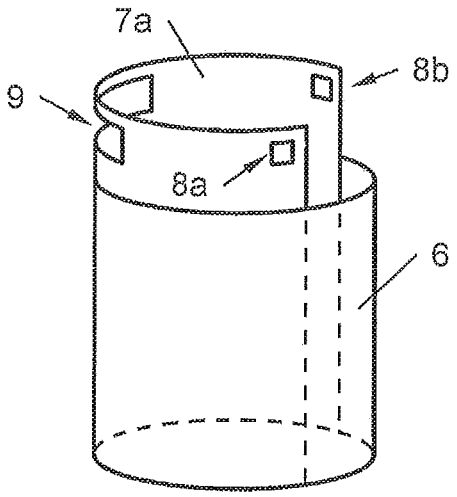
Figure 4:
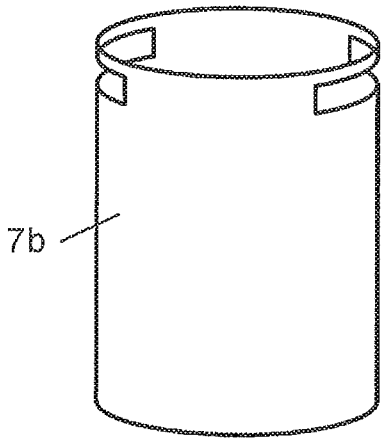
Figure 5:
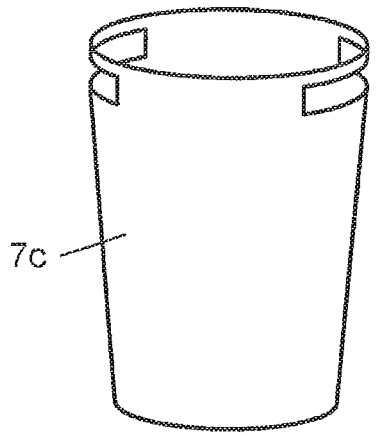

These are highly simplified, schematic diagrams illustrating the following:

FIG. 1 an exemplary and schematically illustrated installation for picking goods in the region of a picking zone;

FIG. 2 a board-shaped picking aid in the flat state;

FIG. 3 the board-shaped picking aid from FIG. 2 rolled up and placed in a bag;

FIG. 4 a tubular picking aid;

FIG. 5 a funnel-shaped picking aid and

Figure 6:
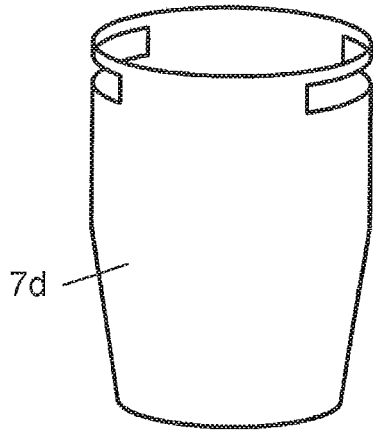

FIG. 6 a picking aid which is partially tubular and partially funnel-shaped.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described.

FIG. 1 shows an exemplary and schematically illustrated installation for picking goods.

The installation has a first conveyor system 1 and a second conveyor system 2 as well as a robot 3. The installation is preferably operated on an automated or at least partially automated basis. The first conveyor system 1 and/or the second conveyor system 2 may be operated on an automated basis or manually. On the first conveyor system 1, goods 4*a* . . . 4*c* are conveyed into a picking zone and on the second conveyor system 2, box-shaped loading aids 5*a* . . . 5*d* are conveyed. Finally, a stack of several bags 6 and a stack of picking aids 7*a* are disposed in the region of the installation. In this example, the bags 6 are limp and can be collapsed flat/folded flat. The conveyor systems 1 and 2 are provided in the form of conveyor belts guided on rollers. It would naturally also be conceivable to opt for other designs, for example roller conveyors. The transport direction of the two conveyor systems 1 and 2 runs from left to right in FIG. 1 (see also the arrow in FIG. 1).

Although it is of advantage to use a first and/or second conveyor system 1, 2, the goods 4*a* . . . 4*c* and/or the loading aids 5*a* . . . 5*d* may also be brought into the picking zone and/or conveyed away from it in some other way. For example, industrial trucks (in particular fork lift trucks and stackers) may be used for this purpose. The first conveyor system 1 and/or the second conveyor system 2 may then also be dispensed with.

The method for picking goods 4*a* . . . 4*c* operated by and on the installation takes place as follows.

In a first step, a bag 6 and a box-shaped loading aid 5*a* . . . 5*d* are made ready. Specifically, the robot 3 takes a bag 6 from the stack and an empty loading aid 5*b* is conveyed to the picking zone with the aid of the second conveyor system 2. The bag 6 may be a paper bag, for example, which is also intended for carrying goods 4*a* . . . 4*c* manually and is used in supermarkets, for example. A pouch, carrier bag, pack or tote may just as easily be used instead of the bag 6.

In this example, the loading aid 5*b* is provided in the form of a container, crate or box with a closed base and closed walls and has the basic shape of a cube. It would also be conceivable for the base and/or walls of the loading aid 5*b* to be provided with cut-outs so that the loading aid 5*b* is based on a basket-type design. The loading aid 5*b* may in principle also be based on a basic shape other than a cube and may be round, for example.

In a second step, the bag 6 is placed in the empty loading aid 5*b* by the robot 3. As this happens, the bag 6 is unfolded and is changed from the flat shape it assumes on the stack to an open shape in which it can be filled.

In a third step, a board-shaped, flexible picking aid 7*a* is picked up from the stack and placed in the bag 6. This operation will be explained in detail with reference to FIGS. 2 and 3, FIG. 2 illustrating the board-shaped picking aid 7*a* in its flat form as it is when in the stack and FIG. 3 illustrating the picking aid 7*a* after having been placed in a bag 6.

The picking aid 7*a* is not necessarily placed in the bag 6 in the picking zone. Alternatively, the bags 6 may be supplied to the picking zone with the picking aids 7*a* already placed in them. Furthermore, the bags 6 in the loading aids 5*a*, 5*b* may be conveyed out of a preparation zone with or without a picking aid 7*a* placed in them.

The picking aid 7*a* advantageously has two first cut-outs 8*a* and 8*b* disposed in the corners and a central second cut-out 9. The first cut-outs 8*a* and 8*b* serve as an aid when rolling up the picking aid 7*a* and the second cut-out 9 as a handle for subsequently removing the picking aid 7*a* from the bag 6. Naturally, these functions should not be construed in the strict sense because the first cut-outs 8*a* and 8*b* may likewise be used to facilitate removal of the picking aid 7*a* from the bag 6 and the second cut-out 9 may likewise be used to make it easier to roll up the picking aid 7*a*.

With the aid of the robot 3, the picking aid 7*a* is rolled about a vertically oriented axis in FIG. 2. To this end for example, the robot 3 is able to hang the picking aid 7*a* on a fixed hook (not illustrated in FIG. 1) by the first cut-out 8*a*, grasp the second cut-out 8*b* and then effect a circular motion so that the second cut-out 8*b* is moved into the region of the first cut-out 8*a* and in particular placed in an overlapping position with it. In particular, the second cut-out 8*b* can now also be hung on said hook. The robot 3 then grasps and removes the rolled picking aid 7*a* from the hook and places it in the bag 6.

In FIG. 1, a single robot 3 is provided in the form of an industrial robot. Accordingly, the robot 3 comprises an arm that can be moved about several axes, to the end of which a gripper is attached. Although the robot 3 may in principle be of the type illustrated in FIG. 1, the diagram of FIG. 1 is somewhat symbolic in character. Robots 3 of a different design may naturally also be used, for example multi-arm robots, gantry robots or robots with fingerlike grippers as well as humanoid robots. In particular, it should be noted that the described motion sequences may also be performed by several (two) robots 3 jointly. For example, it is possible for one robot 3 to hold the picking aid 7 by the first cut-out 8*a* whilst another robot 3 rolls the picking aid 7 by holding onto the second cutout 8*b*. This motion sequence may naturally also be performed by a robot 3 with two arms. Humanoid arms and gripper members may also be used for this purpose.

In a fourth step, the bag 6 is then placed in the box-shaped loading aid 5*b*.

In a fifth step, the goods 4*a* . . . 4*c* conveyed to the picking zone with the aid of the first conveyor system 1 are packed in the bag 6. The nature and number of the goods 4*a* . . . 4*c* to be packed will depend on a picking order (detected electronically) which is set up beforehand, for example by a central computer and/or master computer on the basis of a customer order.

In a sixth step, the filled bag 6 is conveyed out of the picking zone by means of the second conveyor system 2. In FIG. 1, loading aids 5*c* and 5*d* have already been packed whereas loading aids 5*a* and 5*b* are still empty.

Generally speaking, the picking aid 7*a* can be rolled up to form a closed or open (cylindrical) tube. In FIGS. 1 and 3, the picking aid 7*a* is rolled up to form an open tube because $d \cdot \pi > l$, where d denotes the diameter of the bag 6 and l the length of the picking aid 7*a*. It would naturally also be conceivable for the same picking aid 7*a* to be rolled more tightly for use in smaller bags 6. In the case of values $d \cdot \pi \leq l$, the resultant tube is closed, i.e. the ends of the picking aid 7*a* overlap. The picking aid 7*a* can therefore be used in a flexible manner for different bag sizes. In a totally similar way, the picking aid 7*a* may also be rolled to form a closed or open (conically shaped) funnel (see also FIGS. 5 and 6). This makes it easier to insert the picking aid 7*a* in the bag.

It is of advantage if the board-shaped picking aid 7*a* relaxes in the bag 6, as illustrated in FIGS. 1 and 3. In this manner, the opening of the bag 6 is effectively spread open and the bag 6 also stands in a relatively stable arrangement. This variant is also particularly suitable for use with paper bags which barely stretch and thus do not readily adapt to tubular or funnel-shaped picking aids (see FIGS. 4 to 6).

It is generally of advantage if the picking aid 7*a* remains in the bag 6 when transporting the box-shaped loading aids 5*a* . . . 5*d*. The bags 6 thus retain their shape even under the effect of high accelerations. Goods 4*a* . . . 4*c* in one bag 6 cannot therefore damage goods 4*a* . . . 4*c* in another bag 6. For example, heavy food cans 4*a* or bottles 4*b* packed in one bag 6 will not then cause damage to tomatoes 4*c* packed in an adjacent bag 6, even if subjected to high accelerations.

It is of particular advantage in this connection if a total surface area of opening cross-sections of bags 6 to be placed in the box-shaped loading aid 5*a* . . . 5*d*, which results when the openings of all the bags (6) are shaped to circles or squares, exceeds the base surface of the loading aid (5*a* . . . 5*d*). This enables the best possible use to be made of the loading aid 5*a* . . . 5*d* on the one hand and the bags 6 stand in the loading aids 5*a* . . . 5*d* in a very stable arrangement and retain their shape and position in the loading aid 5*a* . . . 5*d* even under the effect of high accelerations.

The picking aid 7*a* may be left where it is whilst the loading aid 5*a* . . . 5*d* is being transported on a conveyor system (e.g. in a warehouse or distribution center), for example, but removed when the bags 6 are being transferred to a vehicle. However, it would also be conceivable for the picking aids 7*a* to be left in the bags 6 when being transported in a vehicle. In the vehicle, the bags 6 can be transported loose or may be left in the loading aid 5*a* . . . 5*d*. For example, return of the picking aids 7*a* and/or loading aids 5*a* . . . 5*d* can be assured with the aid of a deposit scheme.

Generally speaking, however, it would also be conceivable for the picking aid 7*a* to be removed from the bag 6 before dispatching the box-shaped loading aid 5*a* . . . 5*d* (e.g. in the picking zone, on leaving the picking zone, in a removal zone downstream of the picking zone or at the goods dispatch point, for example). In this manner, only a small number of picking aids 7*a* are required for the proposed method.

In addition to board-shaped picking aids 7*a* which can be stored flat in a particularly space saving arrangement, it would also be conceivable to use picking aids of a different shape.

In this connection, FIG. 4 illustrates a (cylindrical) tubular picking aid 7*b* having two handle-shaped cut-outs. Advantageously, these picking aids 7*b* do not need to be rolled up, which makes it easier to place the picking aids 7*b* in the bag 6 and the picking operation as a whole can be implemented more quickly. The tubular picking aid 7*b* may be substantially rigid or elastically deformable by hand.

FIG. 5 illustrates another embodiment of a picking aid 7*c* which is very similar to the picking aid 7*b* illustrated in FIG. 4. The difference is that this one is not (cylindrical) tubular but funnel-shaped. Placing the picking aid 7*c* in the bag 6 is therefore made even easier. In addition to the fact that the funnel-shaped picking aid 7*c* is easier to place in the bag 6 than the tubular picking aid 7*b*, it has another advantage in that several funnel-shaped picking aids 7*c* can be stacked in a space saving arrangement as they can be stacked one inside the other.

FIG. 6, finally, also illustrates an embodiment which is based on a combination of the shapes illustrated in FIGS. 4 and 5. The picking aid 7*d* is tubular in the top part and funnel-shaped in the bottom part.

The embodiments illustrated as examples represent possible variants of the system for picking goods as well as different picking aids 7*a* . . . 7*d* for this purpose, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants of embodiments which are possible by combining individual details of the embodiments described and illustrated fall within the scope of the invention.

In particular, it should be noted that although the proposed method is illustrated in the examples as being implemented by a robot 3, parts of the method or also the entire method may be implemented by a picker. In particular, this includes placing the picking aid 7*a* . . . 7*d* in the bag 6, placing the bag 6 in the loading aid 5*a* . . . 5*d* and filling the bags with goods 4*a* . . . 4*c*. In particular, it would also be conceivable for the picking aid 7*a* . . . 7*d* to be placed in the bag 6 by a robot 3 but for the bag 6 to be packed with goods 4*a* . . . 4*d* by a picker or vice versa. The task of placing the bag 6 in a loading aid 5*a* . . . 5*d* may also be carried out by a robot 3 or a staff member. However, the installation is preferably operated on an automated basis and only the picking is carried out by a picker.

In particular, with regard to the fifth step, the manual picking process still has to be described. In principle, a differentiation is made between "goods to man order picking" and "man to goods order picking". In the case of "goods to man order picking", the goods 4*a* . . . 4*c* are taken out of a warehouse (not illustrated), in particular an automatic small parts warehouse (SPW), and transported by the first conveyor system 1 to the picking zone where the picking operation ultimately takes place and the goods 4*a* . . . 4*c* are packed in the at least one bag on the basis of a picking order. The goods 4*a* . . . 4*c* are usually stored in "box-shaped loading aids", for example bins.

Alternatively, the goods 4*a* . . . 4*c* may also be stored in shelves located in the picking zone. The goods 4*a* . . . 4*c* may also be stored there in "box-shaped loading aids" although this is not necessarily the case. The first conveyor system 1 can be dispensed with. The picker moves to the shelves, takes the goods 4*a* . . . 4*c* from them and then packs the goods 4*a* . . . 4*c* in the bag 6 on the basis of a picking order. This system is known as "man to goods order picking". In principle, this "dynamic or static" supplying of the goods 4*a* . . . 4*c* in the picking zone may also be implemented by the robot 3 in the embodiment described above.

The specified steps may be carried out wholly or partially in separate locations from one another. For example, the picking aid 7*a* . . . 7*d* may be placed in the bag 6 in a preparation zone disposed upstream of the picking zone and the required facilities provided in the picking zone. In addition, the bags 6 with the picking aids 7*a* . . . 7*d* may be placed in the in loading aids 5*a* . . . 5*d* in said preparation zone, in which case only the process of packing the bags 6 with goods 4*a* . . . 4*d* takes place in the picking zone. The picking aid 7*a* . . . 7*d* may be removed: in the picking zone. However, the aid 7*a* . . . 7*d* may also be removed in a separate removal zone disposed downstream of the picking zone, for example.

In particular, it should be noted that the steps carried out for the picking method need not necessarily be implemented one after the other in the specified order but may be implemented (at least partially) simultaneously or in a different order. For example, the picking aid 7*a* . . . 7*d* may be placed in the bag 6 after the bag 6 has been placed in the loading aid 5*a* . . . 5*d*. It would also be conceivable for the two steps to be implemented simultaneously, i.e. the bag 6 is placed in the loading aid 5*a* . . . 5*d* and at the same time or overlapping in time the picking aid 7*a* . . . 7*d* is placed in the bag 6.

Loading aids 5*a* . . . 5*d* and/or goods 4*a* . . . 4*c* can be transported in and out at the same time as the picking aids 7*a* . . . 7*d* are being placed in the bags 6, bags 6 are being placed in the loading aids 5*a* . . . 5*d* and the bags are being packed with goods 4*a* . . . 4*c*. For example, the robot 3 can overlap the movement for placing the picking aid 7*a* . . . 7*d* in the bag 6 with a movement corresponding to the movement of the first and/or second conveyor system 1, 2 so that the conveyor systems 1, 2 can be kept in permanent motion. In this connection, it would also be conceivable for the robot 3 or other devices for implementing method steps of the method for picking goods 4*a* . . . 4*d* to be capable of a translating movement so that they can move along the conveyor systems 1, 2. Also, the bags 6 and/or picking aids 7*a* do not have to be stacked in situ but can be brought in by conveyor systems like the goods 4*a* . . . 4*d* and loading aids 5*a* . . . 5*d*.

In particular, it should be noted that in reality, the illustrated devices may also have more or fewer components than those illustrated.

For the sake of good order, finally, it should be pointed out that, in order to provide a clearer understanding of the system for picking goods as well as the picking aids 7*a* . . . 7*d*, they and their constituent parts are illustrated to a certain extent out of scale and/or on an enlarged scale and/or on a reduced scale.

The objective underlying the independent inventive solutions may be found in the description.

LIST OF REFERENCE NUMBERS

1 First conveyor system
2 Second conveyor system
3 Robot
4*a* . . . 4*c* Goods
5*a* . . . 5*d* Loading aid
6 Bag
7*a* . . . 7*d* Picking aid
8*a*, 8*b* First cut-out
9 Second cut-out The invention claimed:

1. Method for picking goods in a picking zone, comprising the steps
providing a picking order,
providing goods,
providing at least one bag, at least one box-shaped loading aid, and at least one picking aid,
placing the at least one bag in the at least one box-shaped loading aid,
placing the at least one picking aid in the at least one bag by means of which a filling opening of the at least one bag is held open at least for the duration of a picking operation,
after placing the at least one picking aid in the at least one bag, packing the goods in the at least one bag in the picking zone on the basis of the picking order, and
conveying the at least one box-shaped loading aid with the packed bag out of the picking zone.

2. Method according to claim 1, wherein the at least one picking aid is tubular and/or funnel-shaped and is placed in the at least one bag.

3. Method according to claim 1, wherein the at least one picking aid is board shaped, flexible and is rolled up and inserted in the bag.

4. Method according to claim 3, wherein the board-shaped picking aid is released in the at least one bag.

5. Method according to claim 3, wherein the at least one picking aid is stored flat after having been removed from the at least one bag.

6. Method according to claim 1, wherein the at least one picking aid remains in the at least one bag when the at least one box-shaped loading aid is being conveyed.

7. Method according to claim 1, wherein the at least one bag and the at least one box-shaped loading aid are held in readiness in a preparation zone, in which case the at least one bag is placed in the at least one box-shaped loading aid and then the at least one box-shaped loading aid with the at least one bag is conveyed out of the preparation zone into the picking zone and the goods are packed in the at least one bag in the picking zone.

8. Method according to claim 7, wherein the a plurality of picking aids are also held in readiness in the preparation zone, in which case the at least one picking aid is placed in the at least one bag before the at least one box-shaped loading aid is conveyed out of the preparation zone into the picking zone.

9. Method according to claim 7, wherein the at least one picking aid is held in readiness in the picking zone, in which case the at least one picking aid is placed in the at least one bag in the picking zone.

10. Method according to claim 1, wherein the at least one bag, the at least one box-shaped loading aid and the at least one picking aid are held in readiness in the picking zone and the at least one bag is placed in the at least one box-shaped loading aid first of all, after which the at least one picking aid is placed in the at least one bag and finally the goods are packed in the at least one bag.

11. Method according to claim 1, wherein the at least one picking aid is removed from the at least one bag before the at least one box-shaped loading aid is conveyed out of the picking zone in which the goods were packed in the at least one bag.

12. Method according to claim 1, wherein the at least one picking aid is removed from the at least one bag after conveying the at least one box-shaped loading aid out of the picking zone in which the goods were packed in the at least one bag.

* * * * *